US009353985B2

(12) United States Patent
Oh et al.

(10) Patent No.: US 9,353,985 B2
(45) Date of Patent: May 31, 2016

(54) REFRIGERATOR

(71) Applicant: Samsung Electronics Co., Ltd., Gyeonggi-do (KR)

(72) Inventors: Jong Hoon Oh, Gwangju (KR); Ho Sang Park, Gwangju (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 14/562,184

(22) Filed: Dec. 5, 2014

(65) Prior Publication Data

US 2015/0159936 A1 Jun. 11, 2015

(30) Foreign Application Priority Data

Dec. 6, 2013 (KR) ..... 10-2013-0151337

(51) Int. Cl.
*A47B 95/00* (2006.01)
*F25D 23/02* (2006.01)

(52) U.S. Cl.
CPC ..... *F25D 23/028* (2013.01)

(58) Field of Classification Search
CPC ... F25D 23/02; F25D 23/028; E05Y 2900/31; A47B 95/02; E05B 1/0015
USPC ..... 16/431, 436, 412, DIG. 18, DIG. 19, 16/DIG. 24, DIG. 25, DIG. 41; 312/405.1, 312/405, 348.6
See application file for complete search history.

(56) References Cited

U.S. PATENT DOCUMENTS

| | | | | | |
|---|---|---|---|---|---|
| 3,648,411 | A * | 3/1972 | Saunders et al. | 49/460 |
| 3,935,787 | A * | 2/1976 | Fisher | 411/16 |
| 4,151,681 | A * | 5/1979 | Roberts | 49/382 |
| 5,519,917 | A * | 5/1996 | Cordonnier | 16/422 |
| 5,740,587 | A * | 4/1998 | Onai et al. | 16/412 |
| 5,797,164 | A * | 8/1998 | Donaghy | 16/412 |
| 6,430,780 | B1 * | 8/2002 | Kim et al. | 16/412 |
| 6,735,824 | B2 * | 5/2004 | Tisol, Jr. et al. | 16/412 |
| 8,732,910 | B1 * | 5/2014 | Paul et al. | 16/413 |
| 2005/0161461 | A1 * | 7/2005 | Shin et al. | 220/752 |
| 2006/0200948 | A1 * | 9/2006 | Steurer | 16/412 |
| 2008/0034553 | A1 * | 2/2008 | Wing | 16/412 |
| 2008/0048540 | A1 * | 2/2008 | Kim | 312/408 |
| 2010/0287843 | A1 * | 11/2010 | Oh | 49/460 |
| 2012/0234993 | A1 * | 9/2012 | Byrne et al. | 248/201 |
| 2013/0285527 | A1 * | 10/2013 | Choi et al. | 312/404 |

* cited by examiner

*Primary Examiner* — Janet M Wilkens

(57) ABSTRACT

A refrigerator includes a door rotatably coupled to the body to open and close the body. The refrigerator includes a front side panel comprising a through-hole, a handle coupled to the front side panel to open and close the door, a handle fixing unit coupled to the front side panel while passing through the through-hole, to fix the handle to the door. The refrigerator also includes a reinforcing unit including a coupling hole to which the handle fixing unit is coupled The reinforcing unit is fixed to a rear surface of the front side panel to reinforce the handle fixing unit. The refrigerator also includes a guide part protruding from the rear surface of the front side panel to guide a position of the reinforcing unit such that the coupling hole matches the through-hole. The reinforcing unit is provided with a guide groove into which the guide part is inserted.

20 Claims, 6 Drawing Sheets

REFRIGERATOR

CROSS-REFERENCE TO RELATED APPLICATION(S) AND CLAIM OF PRIORITY

The present application is related to and claims the benefit of Korean Patent Application No. 10-2013-0151337, filed on Dec. 6, 2013, in the Korean Intellectual Property Office, the disclosure of which is incorporated herein by reference.

TECHNICAL FIELD

Embodiments of the present disclosure relate to a refrigerator enabling a handle fixing unit, configured to fix a handle to a door, to be easily assembled to a front side panel of the door.

BACKGROUND

A refrigerator represents a household appliance provided with a main body, including an inner case and an outer case, a storage compartment formed by the inner case, and a cool air supplying device to supply the storage compartment with cool air to keep food in a fresh manner.

The temperature of the storage compartment is maintained within a predetermined temperature range to keep food fresh. The storage compartment of the refrigerator includes an open front surface, and the open front surface is closed by a door to maintain the temperature of the storage compartment.

A handle configured for gripping by a user is coupled to the door to facilitate opening and closing the door. The handle is coupled to the door as a handle fixing unit. The handle fixing unit is coupled to a front side panel of the door. The front side panel of the door is coupled to a connector assembled to the handle.

A structure for reinforcing the handle fixing unit is fixed to a rear surface of the door. A guide hole is formed through the rear surface of the front side panel. The structure for reinforcing the handle fixing unit is provided with a guide protruding while corresponding to the guide hole. However, since the structure for reinforcing the handle fixing unit is provided using an iron plate, and obtained by a press-processing, the protrusion height of the guide is low and thus it is not easy to adjust the guide to the guide hole, causing difficulty in setting the position of the structure for reinforcing the handle fixing unit. If the structure for reinforcing the handle fixing unit is erroneously assembled, and the position of the structure for reinforcing the handle fixing unit is deviated, heat insulating material filled inside the door is infiltrated in between the front side panel of the door and the structure, resulting in product defectives.

In addition, in order to prevent heat insulating material from leaking in between the front side panel and the structure for reinforcing the handle fixing unit after the guide has been adjusted to the guide hole, an additional process of fixing the structure for reinforcing the handle fixing unit is required, such as attaching a double-sided tape between the front side panel and the structure for reinforcing the handle fixing unit or fixing a surrounding area of the structure for reinforcing the handle fixing unit using an additional fixing device, such as a rivet or a tape.

SUMMARY

To address the above-discussed deficiencies, it is a primary object to provide a refrigerator having an improved structure to facilitate coupling a handle fixing unit, configured to couple a handle to a door, to a front side panel of the door. Additional aspects of this disclosure will be set forth in part in the description which follows and, in part, will be obvious from the description, or can be learned by practice of the disclosure.

In an embodiment, a refrigerator includes a body, a door, a handle, a handle fixing unit, a reinforcing unit and a guide part. The door is rotatably coupled to the body to open and close the body, and provided with a front side panel having a through-hole. The handle is coupled to the front side panel to open and close the door. The handle fixing unit is coupled to the front side panel while passing through the through-hole, to fix the handle to the door. The reinforcing unit includes a coupling hole, to which the handle fixing unit is coupled, and is fixed to a rear surface of the front side panel to reinforce the handle fixing unit. The guide part protrudes from the rear surface of the front side panel to guide a position of the reinforcing unit such that the coupling hole matches the through-hole. The reinforcing unit is provided with a guide groove into which the guide part is inserted.

One side of the handle fixing unit is provided as a bolt part having a screw thread, and the coupling hole is provided at an inside thereof with a nut formed in an insert molding and have a screw thread corresponding to the screw thread of the bolt part, so that the handle fixing unit is coupled to the coupling hole by passing through the through-hole. The coupling hole is provided with an infiltration preventing layer to prevent heat insulating material filled inside the door from being infiltrated into the coupling hole. The infiltration preventing layer is penetrated by the handle fixing unit when the handle fixing unit is coupled to the coupling hole.

The guide part is provided with a locking hole to which the reinforcing unit is fixed, and the reinforcing unit is provided with a locking protrusion fixed to the locking hole. The front side panel is provided with a guide hole to guide a position of the reinforcing unit, and the reinforcing unit is provided with an accommodation part provided in a shape corresponding to a shape of the guide hole so as to be accommodated in the guide hole when the reinforcing unit is fixed to the guide part. The accommodation part is provided at one side thereof with a protrusion that protrudes to the outside of the guide hole when the reinforcing unit is fixed to the guide part. The handle presses the protrusion while making contact with the protrusion when the handle is coupled to the front side panel. The reinforcing unit is formed using plastic material, and a plurality of concave-convex parts are formed on a surface of the reinforcing unit which makes contact with the front side panel while being spaced apart from each other. The heat insulating material filled in the door flows between the plurality of concave-convex parts to prevent the heat insulating material from leaking to the outside of the door when the heat insulating material is infiltrated between the front side panel and the reinforcing unit.

In another embodiment, a refrigerator includes a body, a door, a handle, a handle fixing unit and a reinforcing unit. The door is rotatably coupled to the body to open and close the body and is provided with a front side panel having a through-hole. The handle is coupled to the front side panel to open and close the door. The handle fixing unit is coupled to the front side panel while passing through the through-hole to fix the handle to the door. The reinforcing unit is fixed to a rear surface of the front side panel to reinforce the handle fixing unit. The reinforcing unit includes a trap structure to prevent heat insulating material filled inside the door from being infiltrated between the front side panel and the reinforcing unit.

The reinforcing unit is formed using plastic material and a plurality of concave-convex parts are formed on a surface of the reinforcing unit which makes contact with the front side panel while being spaced apart from each other. The heat insulating material filled inside the door flows between the plurality of concave-convex parts to prevent the heat insulating material from leaking to the outside of the door when the heat insulating material is infiltrated between the front side panel and the reinforcing unit.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely. Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

Figure 1:
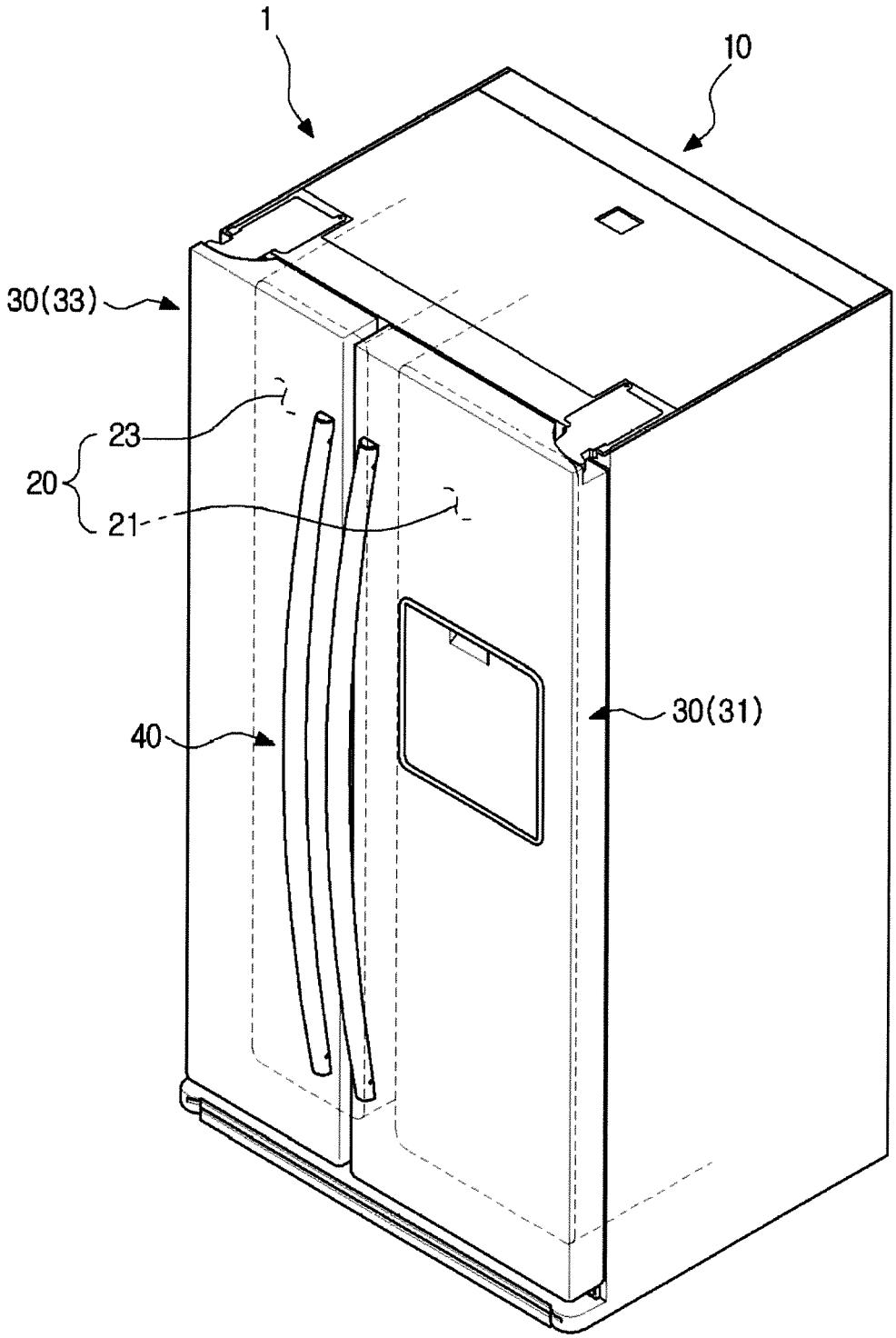
FIG. 1 is a perspective view illustrating an example refrigerator according to this disclosure.

FIGS. 1 through 6, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged refrigeration device. Reference will now be made in detail to the embodiments of the present disclosure, examples of which are illustrated in the accompanying drawings, wherein like reference numerals refer to like elements throughout.

Figure 2:
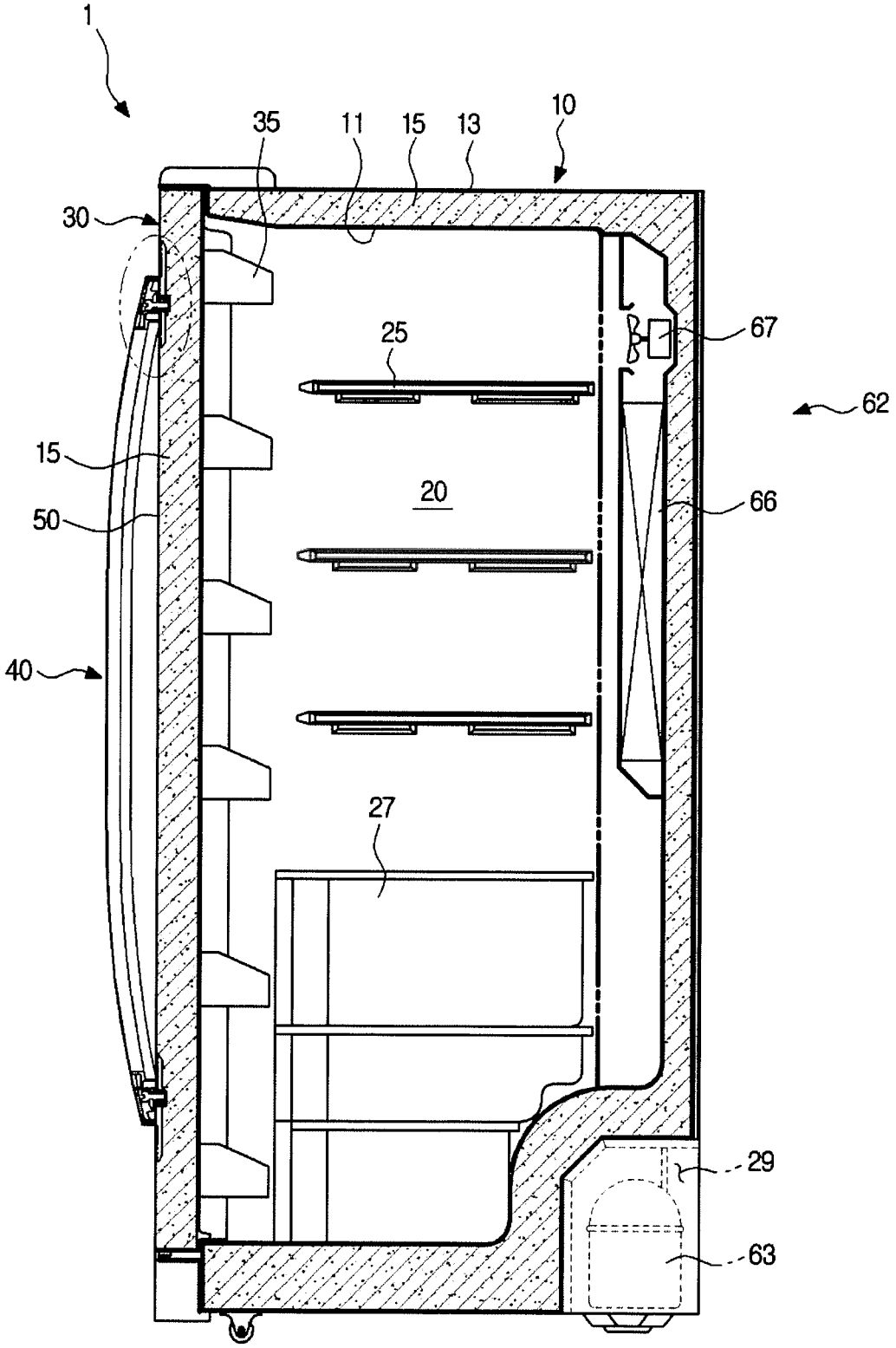
FIG. 2 is a cross-sectional view illustrating an example refrigerator according to this disclosure.

FIG. 1 is a perspective view illustrating an example refrigerator according to this disclosure. FIG. 2 is a cross-sectional view illustrating an example refrigerator according to this disclosure. Referring to FIGS. 1 and 2, a refrigerator 1 includes a body 10 forming an external appearance of the refrigerator, a storage compartment 20 provided inside the body 10 to have a front surface thereof open, and a door 30 rotatably (such as pivoting) coupled to the body 10 to open and close the open front surface of the storage compartment 20.

The body 10 includes an inner case 11 forming the storage compartment 20, an outer case 13 forming an exterior appearance and a cool air supplying apparatus 60 to supply the storage compartment 20 with cool air, and heat insulation material 15 is foamed between the inner case 11 and the outer case 13 to prevent cool air of the storage compartment 20 from being discharged. The cool air supplying apparatus 62 includes a compressor 63, a condenser, an expansion valve, an evaporator 66 and a blower fan 67. In addition, the body 10 includes a partition to divide the storage compartment 20 into a left portion and a right portion, that is, into a refrigerating compartment 21 and a freezing compartment 23, and a machine room 29 is provided at a lower rear portion of the body 10 such that the compressor 63 to compress refrigerant and the condenser to condense the compressed refrigerant are installed therein.

The storage compartment 20 is divided into a left portion and a right portion by the partition, and the refrigerating compartment 21 and the freezing compartment 23 are provided at the right portion and the left portion of the body 10, respectively. A plurality of shelves 25 and storage containers 27 are provided in the storage compartment 20 to store food. The storage compartment 20 are open and closed by the door 30 that is rotatably coupled to the body 10, and the refrigerating compartment 21 and the freezing compartment 23 divided into the left side and the right side by the partition are open and closed by a refrigerating door 31 and a freezing door 33, respectively.

The refrigerating door 31 and the freezing door 33 are provided at rear surfaces thereof with a plurality of door guard 35 to accommodate food. A handle 40 that can be gripped by a user is coupled to the door 30 to facilitate opening and closing the door 30. The handle 40 is provided in the form of a hollow cylinder, and also in the form of an arch having a central portion protruding further than both end portions so that the handle 40 is easily gripped.

Figure 3:
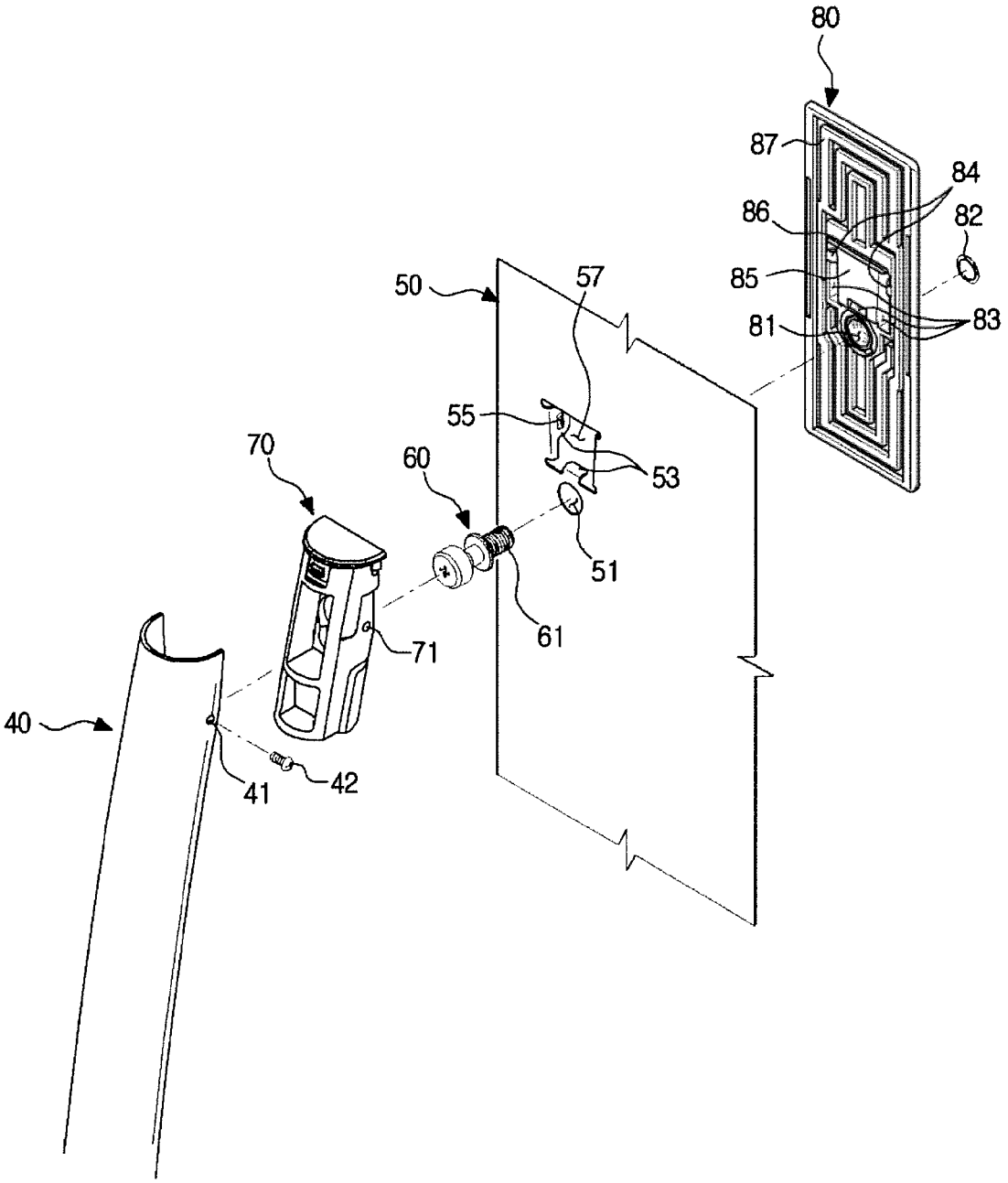
FIG. 3 is a view illustrating an example handle coupled to a front side panel of a door according to this disclosure.
Figure 4:
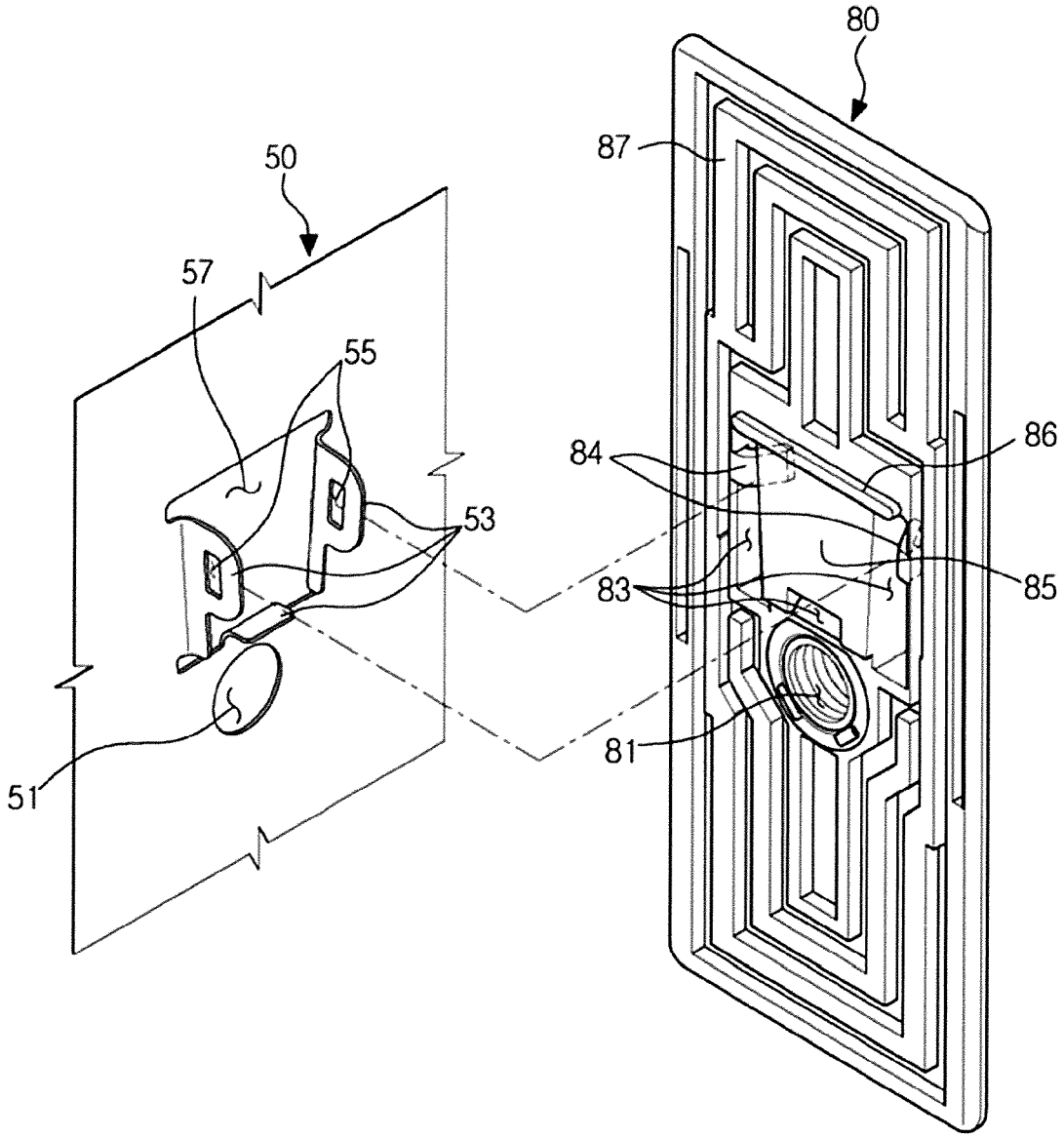
FIG. 4 is a view illustrating an example reinforcing unit fixed to a rear surface of a front side panel of a door according to this disclosure.
Figure 5:
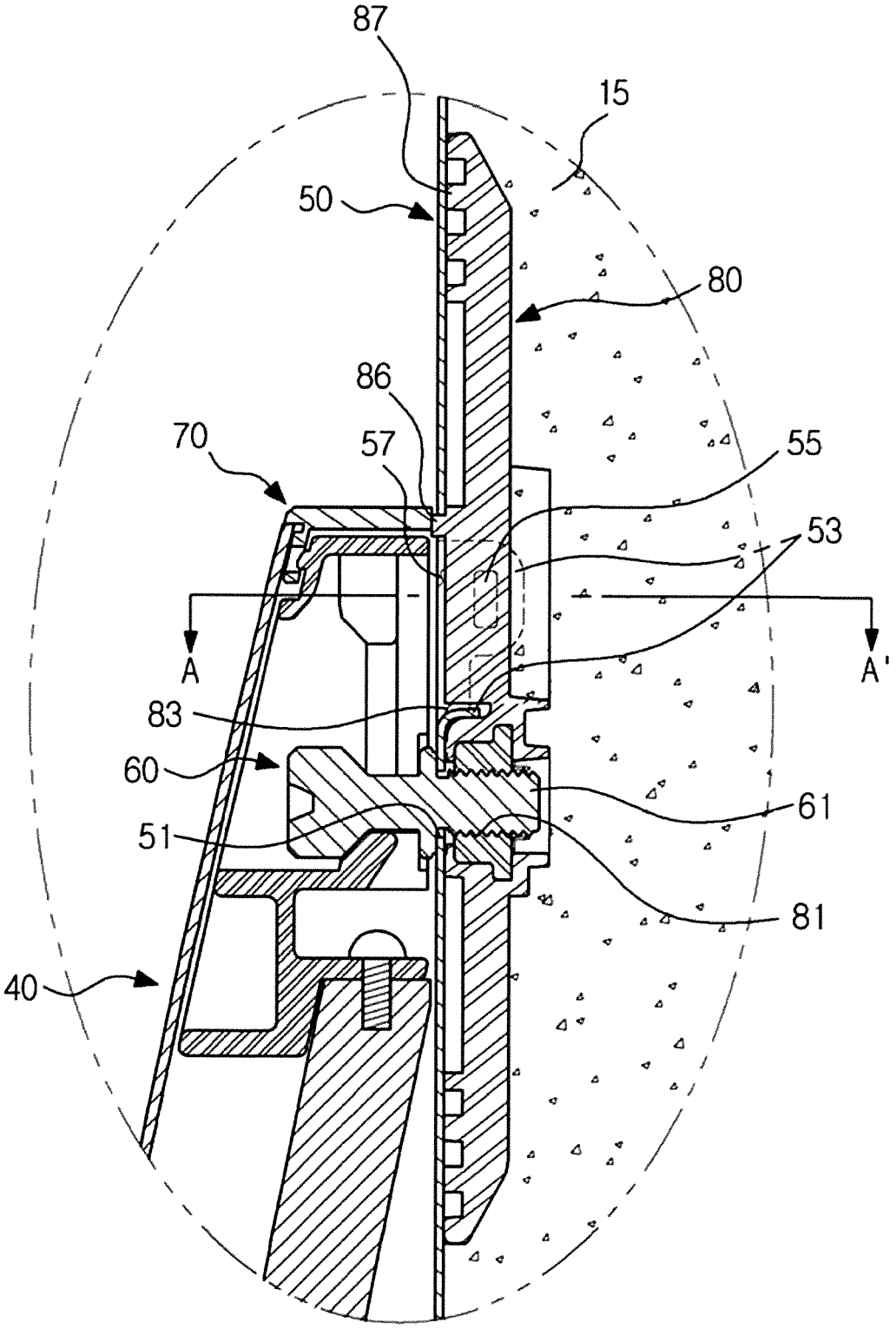
FIG. 5 is a cross-sectional view showing an example handle coupled to a door according to this disclosure.
Figure 6:
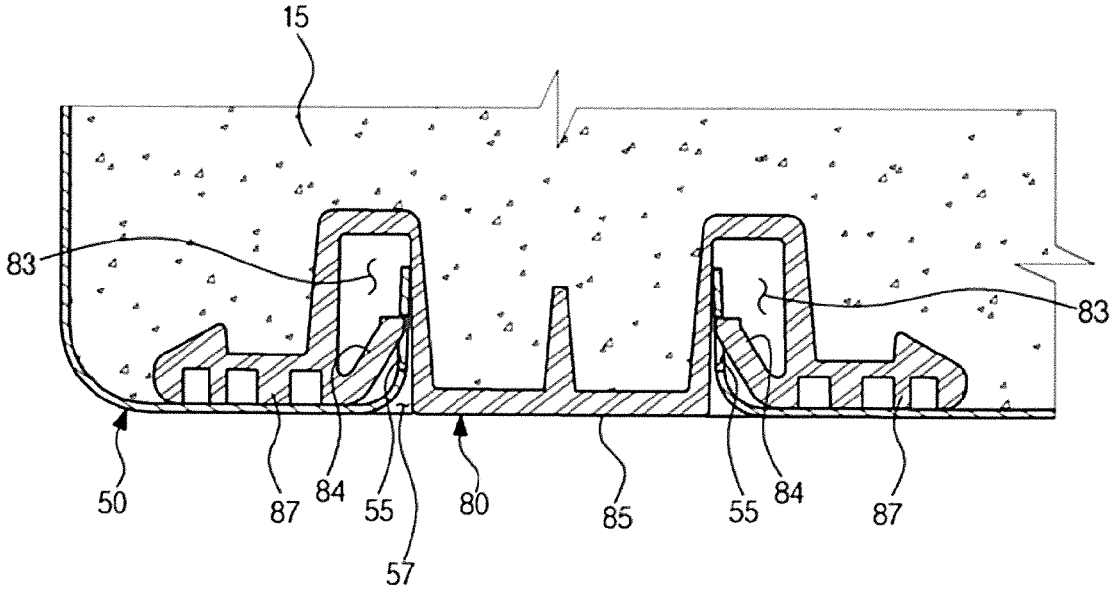
FIG. 6 is another cross-sectional view showing an example handle coupled to a door according to this disclosure.

Hereinafter, a structure to couple the handle 40 to a front side of the door 30 will be described with reference to FIGS. 3, 4, 5, and 6. FIG. 3 is a view illustrating an example handle coupled to a front side panel of a door according to this disclosure. FIG. 4 is a view illustrating an example reinforcing unit fixed to a rear surface of a front side panel of a door according to this disclosure. FIG. 5 is a cross-sectional view showing an example handle coupled to a door according to this disclosure. FIG. 6 is another cross-sectional view showing an example handle coupled to a door according to this disclosure. Referring to FIG. 3, the handle 40 is coupled to a front side panel 50 as a handle fixing unit 60. The handle fixing unit 60 is coupled to the front side panel 50. The front side panel 50 is coupled to a connector 70 assembled to the handle 40.

In order to assemble the handle 40 to the connector 70, the handle 40 is provided with a first fastening hole 41, and the connector 70 is provided with a second fastening hole 71 at a position corresponding to the first fastening hole 41, so that after the connector 70 is inserted into the handle 40, a fastening member 42 is fastened to the first fastening hole 41 and the second fastening hole 71, so that the handle 40 is assembled to the connector 70. The handle fixing unit 60 and the connector 70 can be fastened to each other in a state of being accommodated in the connector 70. In addition, the handle fixing unit 60 can be coupled to the connector 70 in a sliding manner in a state of being accommodated in the connector 70.

Referring to FIGS. 3, 4, 5, and 6, a reinforcing unit 80 is fixed to a rear surface of the front side panel 50 to reinforce the handle fixing unit 60 that is coupled to a front surface of the front side panel 50. The reinforcing unit 80 is formed using plastic, and is provided with a coupling hole 81 to which the handle fixing unit 60 having passed through a through-hole 51 formed on the front side panel 50 is coupled. One side of the handle fixing unit 60 is provided as a bolt part 61 having a screw thread. The coupling hole 81 of the reinforcing unit 80 is provided at an inside thereof with a nut formed in an insert molding and having a screw thread corresponding to the screw thread of the bolt part 61, so that the handle fixing unit 60 is coupled to the coupling hole 81 by passing through the through-hole 51.

The coupling hole 81 is provided with an infiltration preventing layer 82 to prevent heat insulating material 15 filled inside the door 30 from being infiltrated into the coupling hole 81. The infiltration preventing layer 82 is provided as a layer having a thin thickness to prevent the heat insulating material 15 from being infiltrated into the coupling hole 81 when the heat insulating material 15 is filled into the inside the door 30. The infiltration preventing layer 82 is penetrated by the bolt part 61 when the handle fixing unit 60 is coupled to the coupling hole 81.

When the reinforcing unit 80 is fixed to the rear surface of the front side panel 50, the through-hole 51 formed through the front side panel 50 is matched to the coupling hole 81 of the reinforcing unit 80 to be coupled to each other, so that the bolt part 61 of the handle fixing unit 60 which is inserted by passing through the through-hole 51 is coupled to the coupling hole 81. In order for the coupling hole 81 of the reinforcing unit 80 to be matched to the through-hole 51 of the front side panel 50, a plurality of guide parts 53 are provided on the rear surface of the front side panel 50 to guide the position of the reinforcing unit 80.

The guide parts 53 protrude from the rear surface of the front side panel 50 and a plurality of guide grooves 83 are formed on the reinforcing unit 80 fixed to the rear surface of the front side panel 50 such that the guide parts 53 are inserted into the guide grooves 83. The guide part 53 includes a structure corresponding to that of the guide groove 83. Accordingly, if the guide part 53 of the front side panel 50 is inserted into the guide groove 83 of the reinforcing unit 80 when the reinforcing unit 80 is fixed to the rear surface of the front side panel 50, the through-hole 51 is matched to the coupling hole 81.

The guide parts 53 protrude from the rear surface of the front side panel 50 while extending from a guide hole 57 provided on the front side panel 50. The guide parts 53 extending from both sides of the guide hole 57 among the plurality of guide parts 53 are provided with locking holes 55 to which the reinforcing unit 80 is fixed. The reinforcing unit 80 is provided with a locking protrusion 84 that is fixed to the locking hole 55 of the front side panel 50 when the position of the reinforcing unit 80 is guided by the guide part 53.

Accordingly, when the reinforcing unit 80 is fixed to the rear surface of the front side panel 50, the position of the reinforcing unit 80 is guided by the guide part 53 while the locking protrusion 84 is being fixed to the locking hole 55. Thus, the reinforcing unit 80 is fixed to the rear surface of the front side panel 50. The front side panel 50 is provided with the guide hole 57 to guide the position of the reinforcing unit 80 in cooperation with the guide part 53. The reinforcing unit 80 is provided with an accommodation part 85 that has a shape corresponding to that of the guide hole 57 and is configured to be accommodated in the guide hole 57 when the reinforcing unit 80 is fixed to the guide part 53.

Accordingly, if the guide part 53 of the front side panel 50 is inserted into the guide groove 83 of the reinforcing unit 80 when the reinforcing unit 80 is fixed to the rear surface of the front side panel 50, the accommodation part 85 of the reinforcing unit 80 is accommodated in the guide hole 57 of the front side panel 50. The accommodation part 85 accommodated in the guide hole 57 forms an approximate same plane together with a front surface of the front side panel 50. The accommodation part 85 is provided at one side thereof with a protrusion 86 that protrudes beyond the accommodation part 85. The protrusion 86 protrudes forward beyond the front surface of the front side panel 50 when the reinforcing unit 80 is fixed to the rear surface of the front side panel 50. Accordingly, when the handle 40 is coupled to the front side panel 50, the handle 40 makes contact with the protrusion 86 of the reinforcing unit 80 before making contact with the front surface of the front side panel 50.

If the front side panel 50 is pressed by the handle 40 when the handle 40 is coupled to the front side panel 50, a lower portion of the front side panel 50 which makes contact with the handle 40 protrudes forward. Thus a gap is generated between the front side panel 50 and the reinforcing unit 80. However, the handle 40 makes contact with the protrusion 86 and presses the protrusion 86 without making a direct contact with the front side panel 50, so that a gap is prevented from being generated between the front side panel 50 and the reinforcing unit 80 protrudes as much as the protrusion 86 protrudes.

A trap structure prevents the heat insulating material 15 filled inside the door 30 from being infiltrated in between the front side panel 50 and the reinforcing unit 80. The trap structure is on a surface of the reinforcing unit 80 which makes contact with the front side panel 50 in the form of a plurality of concave-convex parts being spaced apart from each other. Since the plurality of concave-convex parts 87 are formed on the surface of the reinforcing unit 80 while being spaced apart from each other, the heat insulating material 15 filled inside the door 30 flows between the plurality of concave-convex parts 87 even if the heat insulating material is infiltrated between the front side panel 50 and the reinforcing unit 80. The heat insulating material 15 flows between the plurality of concave convex parts 87 and is delayed from being infiltrated into the coupling hole 81 and so on. Thus, the heat insulating material 15 is hardened for the delay time during which the heat insulating material 15 flows between the plurality of concave convex parts 87. Accordingly, the heat insulating material 15 being infiltrated between the front side panel 50 and the reinforcing unit 80 is prevented from leaking to the outside of the door 40.

As described above, additional parts or additional processes may not be needed to fix a reinforcing unit to a rear surface of a front side panel of a door, thereby reducing the assembly cost and time. In addition, the reinforcing unit is prevented from being erroneously assembled, so that heat insulting material filled inside the door is prevented from moving between the front side panel and the reinforcing unit.

Although the present disclosure has been described with an exemplary embodiment, various changes and modifications may be suggested to one skilled in the art. It is intended that the present disclosure encompass such changes and modifications as fall within the scope of the appended claims.

What is claimed is:

1. A refrigerator comprising:

a body;

a door comprising a front side panel with a through-hole and rotatably coupled to the body to open and close the body;

a handle coupled to the front side panel to open and close the door;

a handle fixing unit coupled to the front side panel and positioned through the through-hole to attach the handle to the door;

a reinforcing unit comprising a coupling hole coupled to the handle fixing unit and attached to a rear surface of the front side panel to reinforce the handle fixing unit; and a guide part protruding from the rear surface of the front side panel to guide a position of the reinforcing unit such that the coupling hole matches the through-hole, wherein the reinforcing unit is provided with a guide groove to insert the guide part, wherein one side of the handle fixing unit is a bolt part comprising a screw thread, and wherein the coupling hole is provided at an inside of the body with a nut formed in an insert molding and comprising a screw thread corresponding to the screw thread of the bolt part so that the handle fixing unit is coupled to the coupling hold by passing through the through-hole.

2. The refrigerator of claim 1, wherein the coupling hole comprises an infiltration preventing layer configured to prevent heat insulating material filled inside the door from infiltrating into the coupling hole.

3. The refrigerator of claim 2, wherein the infiltration preventing layer is penetrated by the handle fixing unit when the handle fixing unit is coupled to the coupling hole.

4. The refrigerator of claim 1, wherein the guide part comprises a locking hole fixed to the reinforcing unit, and wherein the reinforcing unit comprises a locking protrusion fixed to the locking hole.

5. The refrigerator of claim 1, wherein the front side panel comprises a guide hole configured to guide a position of the reinforcing unit, and wherein the reinforcing unit comprises an accommodation part provided in a shape corresponding to a shape of the guide hole so as to be accommodated in the guide hole when the reinforcing unit is fixed to the guide part.

6. The refrigerator of claim 5, wherein the accommodation part is at one side of the refrigerator with a protrusion that protrudes to the outside of the guide hole when the reinforcing unit is fixed to the guide part, and wherein the handle presses the protrusion while making contact with the protrusion when the handle is coupled to the front side panel.

7. The refrigerator of claim 1, wherein the reinforcing unit is formed using plastic material, and wherein a plurality of concave-convex parts are formed on a surface of the reinforcing unit in contact with the front side panel without being in contact with each other.

8. The refrigerator of claim 7, wherein a heat insulating material filled in the door flows between the plurality of concave-convex parts to prevent the heat insulating material from leaking to the outside of the door when the heat insulating material is infiltrated between the front side panel and the reinforcing unit.

9. The refrigerator of claim 1, wherein a heat insulating material filled inside the door flows between a plurality of concave-convex parts to prevent the heat insulating material from leaking to the outside of the door when the heat insulating material is infiltrated between the front side panel and the reinforcing unit.

10. A refrigerator comprising:

a body;

a door comprising a front side panel with a through-hole and rotatably coupled to the body to open and close the body;

a handle coupled to the front side panel to open and close the door;

a handle fixing unit coupled to the front side panel and positioned through the through-hole to attach the handle to the door; and a reinforcing unit attached to a rear surface of the front side panel to reinforce the handle fixing unit, wherein the reinforcing unit comprises a trap structure to prevent heat insulating material filled inside the door from infiltrating between the front side panel and the reinforcing unit, and wherein a plurality of concave-convex parts are formed on a surface of the reinforcing unit in contact with the front side panel without being in contact with each other.

11. The refrigerator of claim 10, wherein the reinforcing unit is formed using plastic material.

12. The refrigerator of claim 10, wherein the heat insulating material filled inside the door flows between the plurality of concave-convex parts to prevent the heat insulating material from leaking to the outside of the door when the heat insulating material is infiltrated between the front side panel and the reinforcing unit.

13. The refrigerator of claim 10, wherein one side of the handle fixing unit is a bolt part comprising a screw thread, and wherein the coupling hole is provided at an inside of the body with a nut formed in an insert molding and comprising a screw thread corresponding to the screw thread of the bolt part so that the handle fixing unit is coupled to the coupling hole by passing through the through-hole.

14. The refrigerator of claim 13, wherein the coupling hole comprises an infiltration preventing layer configured to prevent heat insulating material filled inside the door from infiltrating into the coupling hole.

15. The refrigerator of claim 14, wherein the infiltration preventing layer is penetrated by the handle fixing unit when the handle fixing unit is coupled to the coupling hole.

16. The refrigerator of claim 10, further comprising a guide part protruding from the rear surface of the front side panel to guide a position of the reinforcing unit such that the coupling hole matches the through-hole.

17. The refrigerator of claim 16, wherein the reinforcing unit is provided with a guide groove for inserting the guide part.

18. The refrigerator of claim 16, wherein the guide part comprises a locking hole fixed to the reinforcing unit, and wherein the reinforcing unit comprises a locking protrusion fixed to the locking hole.

19. The refrigerator of claim 10, wherein the front side panel comprises a guide hole configured to guide a position of the reinforcing unit, and wherein the reinforcing unit comprises an accommodation part provided in a shape corresponding to a shape of the guide hole so as to be accommodated in the guide hole when the reinforcing unit is fixed to the guide part.

20. The refrigerator of claim 19, wherein the accommodation part is at one side of the refrigerator with a protrusion that protrudes to the outside of the guide hole when the reinforcing unit is fixed to the guide part, and wherein the handle presses the protrusion while making contact with the protrusion when the handle is coupled to the front side panel.

* * * * *